US010442112B2

(12) United States Patent
Sperlich et al.

(10) Patent No.: US 10,442,112 B2
(45) Date of Patent: Oct. 15, 2019

(54) METHOD FOR PRODUCING AN ENGINEERED WOOD BOARD AND ENGINEERED WOOD BOARD PRODUCTION INSTALLATION

(71) Applicant: SWISS KRONO Tec AG, Lucerne (CH)

(72) Inventors: Daniel Sperlich, Halenbeck-Rohlsdorf (DE); Andreas Richter, Wittstock (DE)

(73) Assignee: SWISS KRONO TEC AG, Lucerne (CH)

( * ) Notice: Subject to any disclaimer, the term of this patent is extended or adjusted under 35 U.S.C. 154(b) by 66 days.

(21) Appl. No.: 15/380,769

(22) Filed: Dec. 15, 2016

(65) Prior Publication Data

US 2017/0173820 A1 Jun. 22, 2017

(30) Foreign Application Priority Data

Dec. 18, 2015 (EP) ..... 15201298

(51) Int. Cl.

| | |
|---|---|
| ***B27N 3/04*** | (2006.01) |
| ***B27N 7/00*** | (2006.01) |
| ***B27N 1/02*** | (2006.01) |
| ***B27N 3/18*** | (2006.01) |
| ***B27N 3/00*** | (2006.01) |

(52) U.S. Cl.

CPC ..... *B27N 3/04* (2013.01); *B27N 1/02* (2013.01); *B27N 1/029* (2013.01); *B27N 3/002* (2013.01); *B27N 3/18* (2013.01); *B27N 7/005* (2013.01)

(58) Field of Classification Search

CPC ..... B27N 3/002; B27N 3/04; B27N 7/005; B32B 21/00; B32B 21/13; B32B 21/14; B32B 41/00

USPC ..... 156/64

See application file for complete search history.

(56) References Cited

U.S. PATENT DOCUMENTS

| | | | | |
|---|---|---|---|---|
| 5,228,947 | A | 7/1993 | Churchland | |
| 5,459,318 | A | 10/1995 | Cacho et al. | |
| 2001/0042833 | A1* | 11/2001 | Kenway | G01N 25/72 250/341.6 |
| 2004/0121294 | A1 | 6/2004 | Lord et al. | |
| 2007/0222100 | A1* | 9/2007 | Husted | B27N 1/00 264/109 |
| 2009/0188642 | A1 | 7/2009 | Pittman et al. | |
| 2010/0223881 | A1* | 9/2010 | Kalwa | B27N 3/10 52/782.1 |
| 2015/0343739 | A1* | 12/2015 | Pervan | B32B 5/30 52/582.1 |
| 2017/0087892 | A1* | 3/2017 | Skorzik | B41J 13/0009 |

(Continued)

FOREIGN PATENT DOCUMENTS

| | | |
|---|---|---|
| DE | 3907617 | 8/1990 |
| DE | 102014104760 A1 | 10/2015 |
| EP | 2927003 | 10/2015 |

(Continued)

*Primary Examiner* — George R Koch

(74) *Attorney, Agent, or Firm* — Andrew M. Calderon; Roberts Mlotkowski Safran Cole & Calderon, P.C.

(57) ABSTRACT

A method for producing an engineered wood board. The method includes production of the substrate and application of a fluid to an application area of the substrate by means of an applicator, where the monitoring of the application occurs by means of an infra-red camera such that an inhomogeneity of the application can be detected.

24 Claims, 3 Drawing Sheets

(56) References Cited

U.S. PATENT DOCUMENTS

2017/0120558 A1* 5/2017 Pervan ..... B32B 5/30

FOREIGN PATENT DOCUMENTS

| | | | |
|---|---|---|---|
| JP | 2015169569 | A | 9/2015 |
| WO | 9201540 | A1 | 2/1992 |
| WO | 2015152802 | | 10/2015 |
| WO | 2016078734 | | 5/2016 |

* cited by examiner

METHOD FOR PRODUCING AN ENGINEERED WOOD BOARD AND ENGINEERED WOOD BOARD PRODUCTION INSTALLATION

FIELD OF INVENTION

The invention relates to a method for producing an engineered wood board with the steps (a) production of the substrate and (b) application of a fluid to an application area of the substrate by means of an applicator. In particular, the invention relates to a method for the production of an engineered wood board, especially an MDF or HDF board or a floorboard.

According to a second aspect, the invention relates to an engineered wood board production installation that is designed to produce an engineered wood board, in particular an MDF or HDF board or a floorboard with (a) a substrate production installation for producing a substrate and (b) an applicator for applying a fluid to an application area of the substrate.

BACKGROUND

During the production of engineered wood boards, in particular within the scope of a production method for floorboards, to which the invention also relates, a substrate in the form of a fibre mat is used, which contains wooden fibres and in particular is made from wood fibres and adhesive. A fluid is applied to this substrate, which is then pressed to form an engineered wood board. It is important for the fluid to be applied to the substrate as evenly as possible.

It is possible and represents a preferred embodiment that the application occurs as a spray. Up to now, the vapour resulting from this method has been analysed visually by directing light onto the vapour and observing the scattered light. This is comparatively complex and rather imprecise.

During the production process of floorboards, a fluid in the form of a fluid synthetic resin is also often applied to a substrate in the form of the engineered wood board; a paper layer is then laid on the engineered wood board and both are then pressed in a press under such pressure and at such a high temperature that the resin melts and solidly binds the paper layer with the engineered wood board. Such a method and related device are described in WO 2016/078734 A1, which is incorporated by reference in its entirety. A solid bond between the paper layer and the engineered wood board is an important quality criteria as too weak a bond may lead to bubbles forming between the two. In order to avoid this, it is also vital during this stage in the method to ensure that an even a layer of fluid as possible is applied to the substrate.

US 2009/0188642/A1 describes how to measure the moisture in an engineered wood board using infra-red spectroscopy. This type of measurement is always local and is therefore not able to record small-scale inhomogeneities that may occur during application.

A spatially resolved, infra-red spectroscopic measurement of the content of powdery resin in a plant fibre board is described in JP 2015-169569.

A method is disclosed in WO 92/01540 in which a fluid is applied inhomogenously to a material that is to be hardened, and/or a temperature gradient is applied in order to compensate for the inhomogeneity during the hardening process using microwaves. The temperature is recorded with a thermographic camera and the moisture by means of absorption or reflectivity infra-red spectroscopy, which is complex and not particularly robust.

SUMMARY OF INVENTION

The invention aims to improve the application of a fluid to a substrate.

The invention solves the problem by means of a method according to the preamble that includes the step of monitoring the application of the fluid using an infra-red camera, meaning that an inhomogeneity of the application can be detected.

According to a second aspect, the invention solves the problem by means of an engineered wood board production installation according to the invention that has an infra-red camera, which is designed to automatically record at least one part of the application area. In particular, the infra-red camera is arranged and designed in such a way that an inhomogeneity of the application of the fluid can be detected.

The advantage of the invention is that the inhomogeneity of the applied fluid can be monitored using simple technical means. It has been proven that the vapour or spray resulting from the application is preferably very fine so that it is indeed visible, in particular in the presence of a backlight or when light is coming from the side, but that this visual detection of the vapour distribution is complex and is almost impossible to automate. In contrast, an infra-red camera renders it possible to quickly recognise if an application nozzle is blocked, for example, as it alters the change in temperature in the application area effected by the application of the fluid.

In other words, the temperature distribution of the substrate in the application area is a reliable yet easily detectable measure of the inhomogeneity with which the fluid is applied.

A further advantage is that the process monitoring of the application can be automated using comparatively simple means. This means that the local temperature distribution can be automatically recorded and compared with a nominal temperature distribution; where appropriate, this can be conducted subject to time. If the deviation between the two is too great, this indicates an error in the application of the fluid and a warning signal can be emitted.

Within the scope of the present description a substrate should be understood especially to mean an object made of wood fibres that has either already been pressed or will be pressed at a later stage. According to a preferred embodiment the substrate is a pressed fibre mat. The substrate is preferably an endless substrate that is produced continuously.

In particular a fibre mat is an object that it produced via continuous or intermittent scattering of wood fibres which can be mixed with an adhesive. The pressing of this pressed fibre mat results in an engineered wood board. Within the scope of a method according to the invention a floorboard can also be produced from the engineered wood board.

An infra-red camera should be understood to mean a camera that is designed to record infra-red radiation so that a statement can be made about temperature differences in the recorded image. Of course it is possible for the infra-red camera to also process visible light. The camera can then electrically eliminate signals coming from visible light. The application area lies within the infra-red camera's field of vision. There is also preferably an area in the material flow direction in front of the application area within the field of vision.

The application area should be understood especially to mean the area of the substrate onto which the fluid is or has been applied. The application area can be divided into a deposit area, in which the fluid content of the substrate increases, and the discharge area, which lies in the material flow direction behind the deposit area and in front of a possible press.

The application may constitute a spraying, atomisation or nebulisation, for example. In the spraying process, the fluid is used to generate a vapour in which the fluid is compressed with a carrier gas and promptly de-compressed using a nozzle. The energy used to form the vapour comes from the carrier gas. In the atomisation process, the fluid is pressed through a nozzle without a carrier gas, the energy used to form the vapour coming from the pressure energy of the fluid. In the nebulisation process, the energy used to form the vapour is supplied by a fixed component, for example a rotating component or one that is supplied with an ultrasonic frequency.

The monitoring of the application should be understood especially to mean that a sequence of images is automatically recorded with the infra-red camera; these images can then be used to assess how homogeneously the fluid is applied.

The temperature of the substrate can be measured in a spatially resolved manner with the infra-red camera.

According to a preferred embodiment, the monitoring of the application using an infra-red camera is conducted by recording an inhomogeneity of the application by means of a temperature change that is effected by the application of the fluid. In other words the temperature distribution is determined and used as a proxy for the fluid distribution.

It is preferable if at least one part of the application area is recorded using the infra-red camera, especially across the full width of the substrate. Here, the width refers to the extension perpendicular to the material flow direction.

It is particularly beneficial if the automatic recording of at least the part of the application area occurs in a constant manner, i.e. in regular time intervals. For example, the automatic recording occurs at least every 5 seconds or more frequently. This means that errors that occur during the application of the fluid can be quickly identified and rectified.

According to a preferred embodiment, the applicator is recorded using the infra-red camera. This has the advantage that, for example, any application nozzles that are not functioning correctly can be quickly identified as defect.

According to a preferred embodiment, a temperature change is effected by the application of the fluid. This may occur, for example, by selecting the ambient humidity and ambient temperature in the surrounding area such that the cooling produced by evaporation causes the temperature change. Alternatively or additionally, the fluid may be at a different temperature to the ambient temperature. It is especially favourable if the temperature of the fluid is lower than the ambient temperature as the cooling caused by evaporation intensifies the difference in temperature.

The feature that the inhomogeneity is monitored by means of the temperature change should be understood particularly to mean that the temperature change is used to determine whether the fluid has been applied homogeneously or inhomogeneously.

The monitoring preferably occurs passively. This means that no additional energy is applied to the substrate in order to measure the infra-red radiation by means of the infra-red camera. In other words, the heat information from the infra-red camera in particular is used to record the inhomogeneity, but an infra-red spectroscopy does not take place.

According to a preferred embodiment, the substrate is a pressed fibre mat and after the application of the fluid, the pressed fibre mat is pressed by means of a—in particular heated—hot press to form an engineered wood board. A hot press should be understood to mean a press that heats the substrate, especially the pressed fibre mat, by being at a higher temperature than the pressed fibre mat. The substrate is therefore heated by thermal conduction that goes from the hot press into the substrate. A hot press is especially not heated by means of microwaves. The hot press is preferably heated by means of a heat transfer medium, in particular a thermal oil. The hot press is preferably a belt press, especially a double belt press. With double belt presses the substrate is pressed between two circulating press plates. In particular, at least one of the press plates is heated.

The substrate preferably has a maximum thickness of 15, especially a maximum of 10, centimeters. The engineered wood board preferably has a maximum thickness of 4 centimeters.

The substrate preferably has a substrate temperature in the material flow direction in front of the applicator, where the fluid has a fluid temperature during application that differs from the substrate temperature by at least 1 Kelvin, especially at least 5 Kelvin. If the substrate is not the same temperature across its full width perpendicular to the material flow direction, the substrate temperature should be understood to mean the mean of the local temperatures, especially the arithmetic mean. The substrate temperature refers in particular to the area directly in front of the deposit area, especially the area that is at a maximum distance of 1 m in front of the deposit area.

It is possible but not necessary for the substrate temperature to be known absolutely or in a temperature unit. It is sufficient if the temperature difference between the substrate temperature and fluid temperature can be identified. Here, it is possible but not necessary for this temperature difference to be disclosed in the form of a temperature unit, for example in degrees Celsius, Kelvin or Fahrenheit. In particular, it is also possible for the temperature or the temperature difference to be encoded by an electric signal. It is only relevant that temporal and/or spatial temperature differences are detectable so that a decision can be made as to whether the inhomogeneity of the application has changed.

It is beneficial if the temperature of the fluid is measured, but it is not necessary. For example, the fluid may also be at an ambient temperature, while the substrate is at a higher temperature than the surroundings.

It is beneficial if the fluid temperature is lower than the substrate temperature. In this case, the cooling caused by evaporation, which occurs when parts of the fluid evaporate, can intensify the contrast.

The method preferably comprises the steps of a continuous, automatic recording of an inhomogeneity parameter that describes an inhomogeneity of the application of the fluid, i.e. the result of the application. The method preferably comprises the step of an emission of a signal if the inhomogeneity parameter deviates from a predetermined nominal value by more than a predetermined threshold value. For example, the inhomogeneity parameter is at a minimum if the fluid is applied in an ideally homogeneous manner. The more inhomogeneous the application of the fluid, the greater the inhomogeneity parameter. Of course, the inhomogeneity parameter may also reach a maximum in the event of an ideally homogeneous distribution and decline if the application of synthetic resin becomes more inhomogeneous. The recording of the inhomogeneity parameter comprises the recording of images using the infra-red camera and the assessment of these images. Of course, the inhomogeneity parameter may also reach a maximum if the fluid is applied in an ideally homogeneous manner, and become smaller the more inhomogeneous the application of the fluid.

It is possible but not necessary for the signal emitted to be detectable to humans. In particular, it is also possible for the signal to be an electric and/or visual signal. In this case, the signal is preferably transferred to a control device of the engineered wood board production installation.

For example, the inhomogeneity parameter is an application area temperature difference within the application area, especially the discharge area. The application area temperature difference should be understood to mean the maximum temperature difference between two points of groups of points in the application area. Alternatively or additionally, the inhomogeneity parameter may describe a temperature variation within the application area and/or a proportion of the points outside of a predetermined temperature interval, for example around the arithmetic mean.

The method according to the invention preferably comprises the step of an automatic recording of the discharge area using the infra-red camera. It is favourable if the inhomogeneity parameter also describes a discharge area temperature difference that temporally and/or spatially characterises temperature differences in the discharge area.

The production of the substrate preferably comprises a scattering of wood fibres that have been coated in an adhesive to form a pressed fibre mat, where the fluid is applied to the pressed fibre mat after the scattering and the pressed fibre mat is pressed to form an engineered wood board following the application of the fluid. This means that the engineered wood board exhibits a uniform product quality.

It is beneficial if the fluid then comprises at least 50 weight percent, especially 75 weight percent, of water. It is advantageous if the fluid contains a surfactant to improve the moistening of the substrate.

According to a preferred embodiment, the fluid contains 1.5 to 4 weight percent of polyol and 1 to 7 weight percent of anionic surfactants, i.e. one or more surfactants. It is beneficial if the fluid contains a maximum of 1% of nonionic surfactants.

The invention is not restricted to the moistening of the pressed fibre mat, but may also be used later in the process for the production of a floorboard. In order to achieve this, the production of the substrate preferably comprises a scattering of wood fibres coated in an adhesive to form a pressed fibre mat, and a pressing of the pressed fibre mat to form an engineered wood board, where the application of the fluid is an application of fluid synthetic resin and the fluid is applied to a moulding skin, in particular an unpolished moulding skin, of the pressed substrate. It has been proven that a paper layer, which has preferably been applied afterwards, sticks especially well. This results in an engineered wood board in the form of a floorboard workpiece.

The fluid is then preferably a fluid synthetic resin, especially a melamine resin, a urea resin or a mix of a melamine resin and a urea resin.

It has been proven advantageous to apply at least 5 g of fluid synthetic resin per square meter of pressed fibre mat. For example, 10 to 20 milliliters are applied per square meter of substrate. The amount of synthetic resin applied per square meter of pressed fibre mat is smaller than 100 g, in particular smaller than 50 g, preferably smaller than 25 g. In this case, an active drying is not necessary. It is also possible for more than 100 g of fluid synthetic resin to be applied per square meter, but the pressed fibre mat is then preferably dried following application.

The method preferably comprises the steps of an application of at least one paper layer on an upper side/a lower side of the engineered wood board, where the paper layer may be impregnated with a synthetic resin and is preferably a decorative paper, thereby resulting in a paper-coated engineered wood board, and a pressing of the paper-coated pressed fibre mat, causing the synthetic resin to melt and bond with the pressed fibre mat, where the fluid synthetic resin is applied before the application of the paper layer. This causes the paper layer to bond solidly with its base.

The method preferably comprises the steps of an application of an overlay paper layer, which preferably refers to a layer of decorative paper. This preferably occurs following the application of the paper layer. It is also beneficial if a wear protection layer is applied to the paper layer or the overlay paper layer.

The engineered wood board maybe cut within the course of a preferred method. This may produce, for example, a floorboard. Slots and/or keys are preferably inserted into the edge areas of the engineered wood board, especially a floorboard. A method for the production of a floorboard therefore also conforms to the invention.

An engineered wood board production installation according to the invention is preferably designed to conduct a method according to the invention. An engineered wood board production installation according to the invention also preferably comprises an inhomogeneity monitoring device with an infra-red camera. The inhomogeneity monitoring device is preferably installed for the continuous automatic recording of the inhomogeneity parameter. It is favourable if it is also designed to automatically emit a signal if the inhomogeneity parameter deviates from a nominal value by more than a predetermined threshold value.

The engineered board production installation preferably comprises a second applicator, which is arranged redundantly to the first applicator, and a control device that is connected to the first inhomogeneity monitoring device and is installed to automatically switch on the second applicator and switch off the first applicator if the inhomogeneity parameter deviates from the predetermined nominal value by more than the predetermined threshold value.

An engineered wood board production installation therefore conforms to the invention if it is designed to produce an engineered wood board, especially an MDF or HDF board, with (a) a substrate production installation in the form of a pressed fibre mat production installation for producing a substrate in the form of a pressed fibre mat and (b) an applicator for applying a fluid to an application area of the pressed fibre mat, characterised by (c) an infra-red camera, which is designed to automatically record at least one part of the application area such that an inhomogeneity of the application can be detected. The preferred arrangements stated above also apply to this invention. This engineered wood board production installation preferably has a press for pressing the pressed fibre mat to form an engineered wood board.

An engineered wood board production installation that is designed to produce an engineered wood board, especially an MDF or HDF board or a floorboard, with (a) a substrate production installation for producing an engineered wood board by pressing a pressed fibre mat and (b) an applicator for the application of a fluid to an application area of the engineered wood board, characterised by (c) an infra-red camera, which is designed to automatically record at least one part of the application area such that an inhomogeneity of the application can be detected, also particularly conforms to the invention. The preferred arrangements stated above also apply to this invention.

According to a preferred embodiment, the control device of the engineered wood board production installation is designed to automatically control a rejection device so that the rejection device rejects substrates whose inhomogeneity parameter has deviated from the predetermined nominal value during production by more than the predetermined threshold value.

Alternatively or additionally, the control device is designed to automatically mark substrates whose inhomogeneity parameter have deviated from the predetermined nominal value during production by more than the predetermined threshold value by means of a label that encodes this fact. These substrates may then be used for products which are subject to lower demands. This marking process may occur by applying a noticeable label to the substrate, for example an alphanumeric code. Alternatively it is, however, also possible for data to be filed in the control device that can be used to determine—for every section of the substrate—whether the inhomogeneity parameter has deviated from the predetermined nominal value by more than the predetermined threshold value.

BRIEF DESCRIPTION OF DRAWINGS

In the following, the invention will be explained in more detail in the attached drawings. They show FIG. 1 a diagram of an engineered wood board production installation according to the invention for conducting a method according to the invention for producing an engineered wood board, FIG. 2 a detailed schematic view of the engineered wood board production installation according to FIG. 1 and FIG. 3 an image of the engineered wood board production installation according to FIG. 2 that has been recorded by the infra-red camera of the engineered wood board production installation according to FIG. 1.

DETAILED DESCRIPTION

Figure 1:
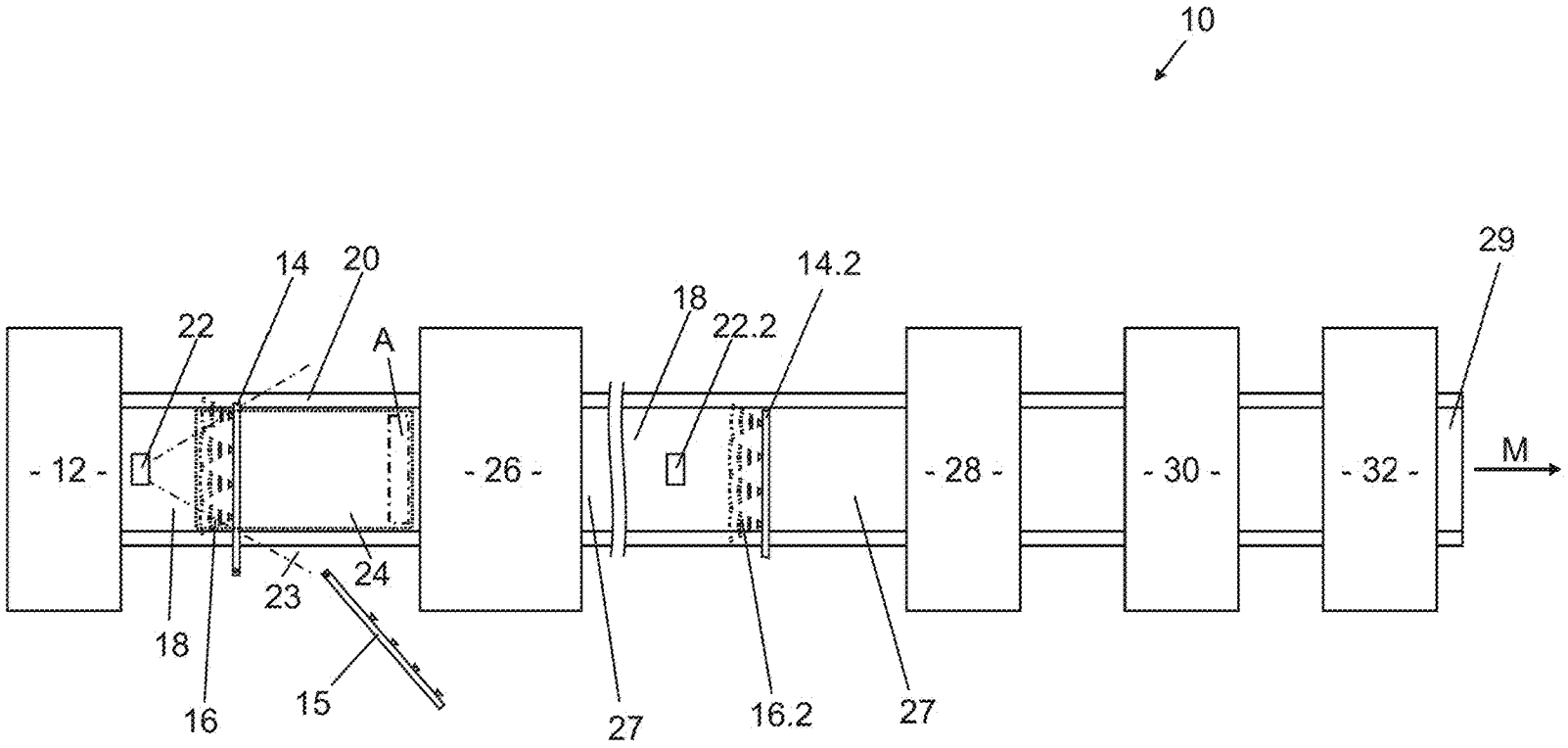

FIG. 1 schematically depicts an engineered wood board production installation 10 that comprises a substrate production installation 12 and an applicator 14 for applying a fluid 16 to a substrate 18. At this point the substrate 18 is a pressed fibre mat and is produced by the substrate production installation 12 by scattering wood fibres that have been coated in an adhesive onto a conveyor 20.

The engineered wood board production installation 10 comprises an infra-red camera 22 in whose field of vision 23 an application area 24 lies. The application area 24 is the area of the substrate 18 that is moistened with fluid 16. A press 26 is arranged in a material flow direction behind the applicator, which presses the pressed fibre mat 18 to form an engineered wood board 27. The press 26 is a double belt press having two belts made from stainless steel that are A cutting device may be provided behind the press 26 in the material flow direction M that cuts the resulting engineered wood board 27 and arranges it in a layer. These devices are not depicted in FIG. 1. This results in the production of engineered wood boards with a temporally and spatially consistent quality.

It is possible, but not necessary, for the engineered wood board 27 to be processed further to form a floorboard 29. The corresponding method according to the invention is explained in the following. The substrate 18, now in the form of the engineered wood board 27, is also moistened with a second fluid 16.2 in the form of a fluid synthetic resin by a second applicator 14.2. This application of the fluid 16.2 is recorded by a second infra-red camera 22.2.

A paper-layering device 28 is arranged behind the second applicator 14.2 in the material flow direction, this device placing a paper layer at least on top of the engineered wood board 27. A second press 30, which may be a high-speed press, arranged behind this device presses the paper layer together with the engineered wood board 27. In an optional downstream trimming system 32, a connection profile, such as a slot and/or a key, is inserted into the edge area of the engineered wood board 27, which results in a floorboard.

Figure 2:
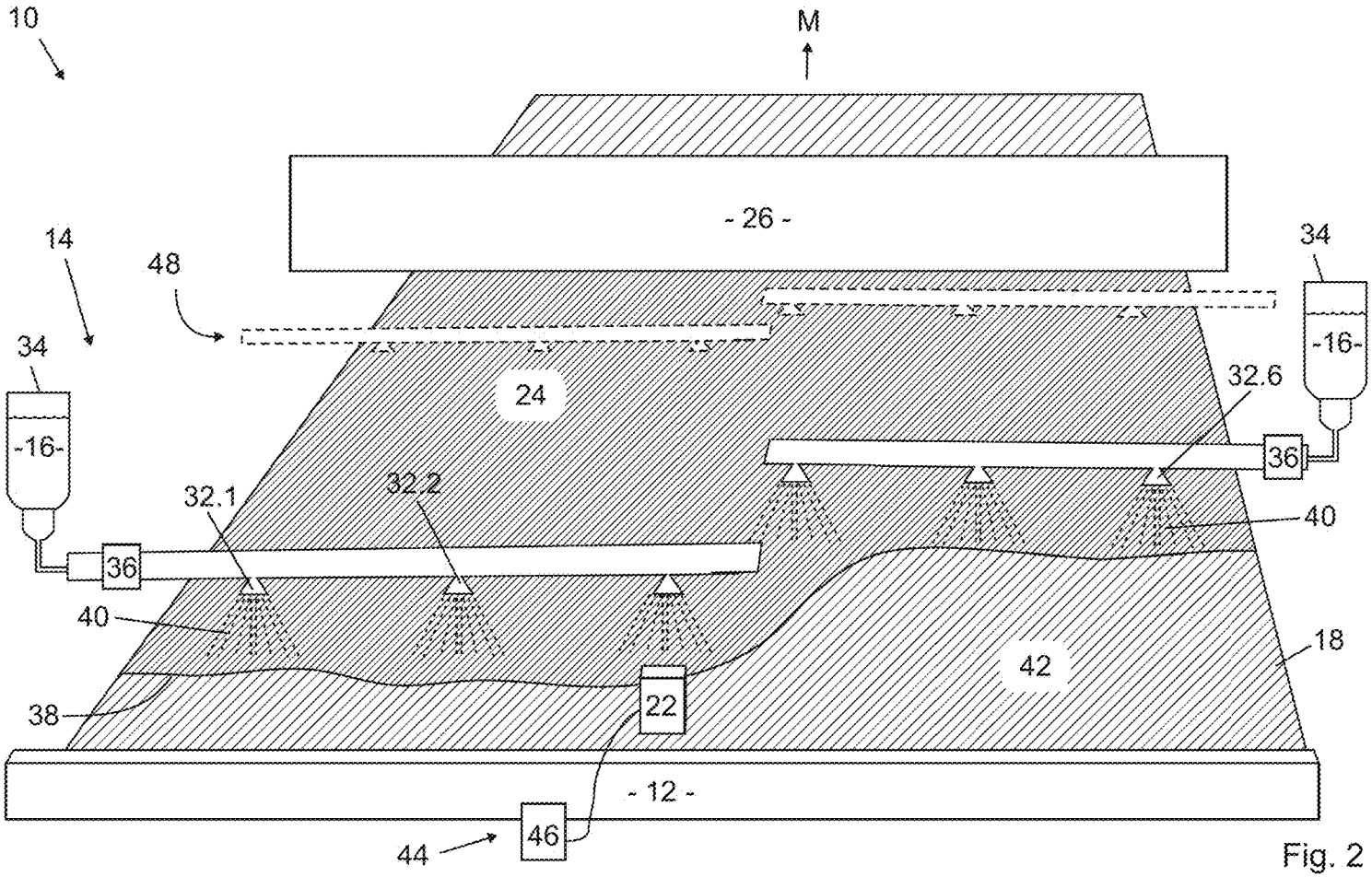

FIG. 2 shows a detailed schematic view of the engineered wood board production installation 10. It should be recognised that the applicator 14 comprises a fluid container 34, a pump 36 for pumping a mixture of the fluid 16 and air, and a number of nozzles 38.1, 38.2, . . . , 38.8. The nozzles **38.*i* (i=1, 2, . . . ) generate a vapour 40 that condenses on the substrate 18 and thereby moistens it. The fluid 16 here refers to water that contains surfactants. If the substrate 18 passes through the press 26**, the water evaporates.

The fluid 16 is at a fluid temperature $T_{16}$ that differs from a substrate temperature $T_{42}$ in a preliminary area 42, the preliminary area 42 being situated in front of the application area 24 in the material flow direction M. By applying the fluid 16, the temperature of a surface piece of the substrate 18 decreases, which is recorded by the infra-red camera 22.

Figure 3:
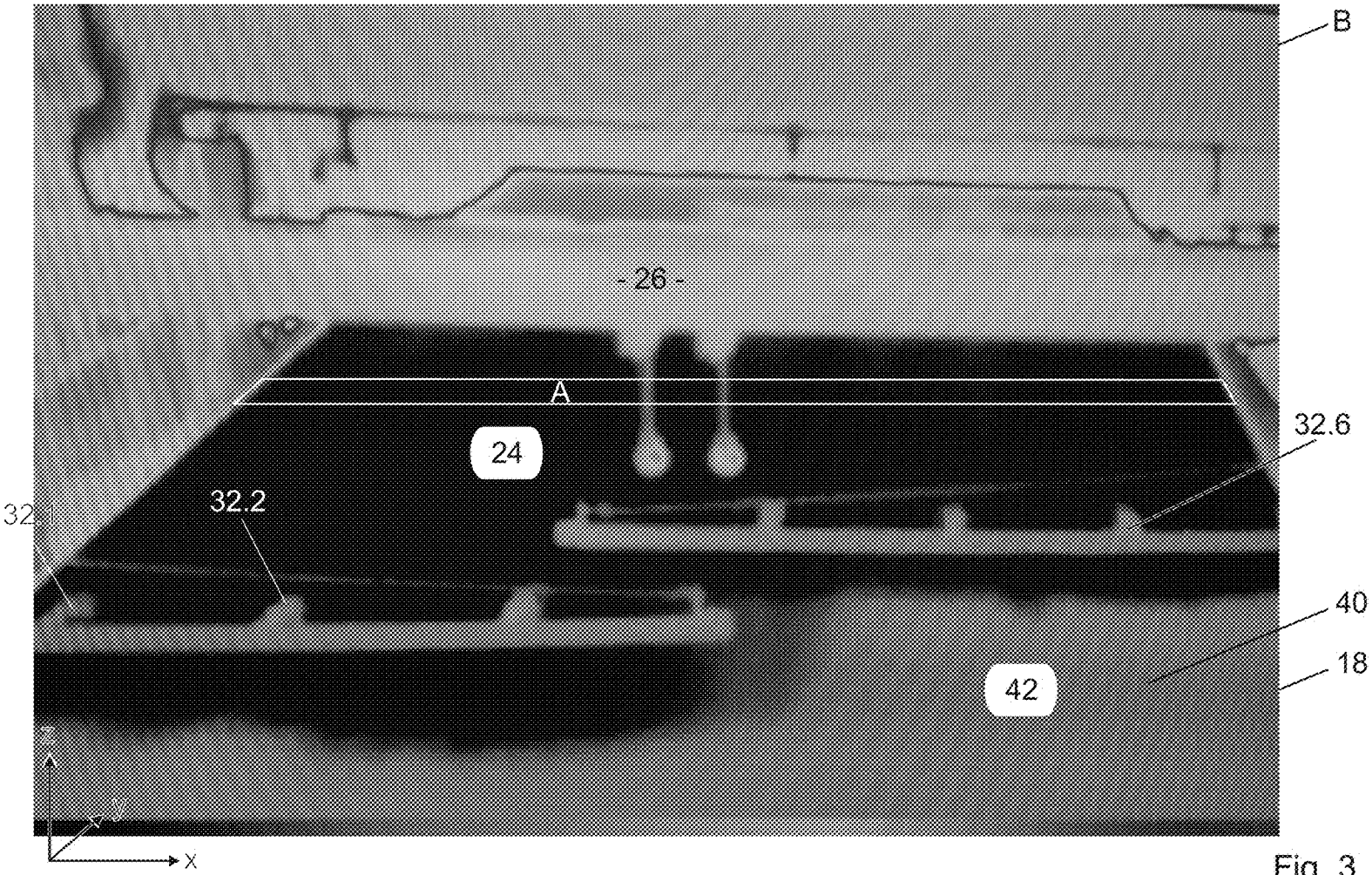

FIG. 3 shows an image B that was recorded by the infra-red camera 22. It should be noted that the preliminary area 42 is warmer than the application area 24. The infra-red camera 22 (see FIG. 2) continually records this type of image B, for example five images or more per second. A measurement area A is determined within the application area 24. The infra-red camera 22 is part of an inhomogeneity monitoring device 44, which also comprises an evaluation unit 46. The evaluation unit 46 is designed to automatically determine an inhomogeneity parameter P, which may be calculated in the way defined in the following.

The temperature of every pixel in the image B that lies within the measurement area A is determined. The average temperature in the extreme quantiles in then determined, for example in the first decile (T1:10) and the tenth decile (T10:10). If the temperature difference ΔT=T1:10−T10:10 of these two temperatures deviates from a nominal value, for example S=0 Kelvin by more than a predetermined threshold value F, a warning signal is emitted.

This warning signal may be an acoustic and/or visual signal that signalises to an operator of the engineered wood board production installation 10 that there is a possible malfunction. Alternatively or additionally, the engineered wood board production installation 10 may comprise a redundant auxiliary applicator 48 that is depicted by a dotted line in FIG. 2. If the inhomogeneity parameter P deviates too much from the nominal value S, the engineered wood board production installation 10 automatically converts to the auxiliary applicator 48 so that the applicator 14 can be repaired and/or cleaned.

FIG. 1 shows that the engineered wood board production installation 10 may comprise a back-up applicator 15 that may be located in material flow direction M behind or in front of the applicator 14. The applicator 14 and/or the back-up applicator 15 may be mounted in a moveable way in order to be moved from an application position into a maintenance position. In FIG. 1, the back-up applicator 15 is shown in its maintenance position and the applicator 14 is in its application position. For example, the applicator 14 and/or the back-up applicator 15 may be swivel-mounted so that it can be pivoted from its application position into its maintenance position and vice versa.

It is possible to determine with the infra-red camera 22 if one or more of the nozzles 38 (cf. FIG. 2) is not working properly and/or if, for example, a liquid tank containing the fluid 16 is empty. If one of the nozzles 38 of the applicator 14 is not working properly, e.g. because it is blocked, the applicator may be shut off an the back-up applicator 15 used to apply the fluid 16. The applicator is then moved into its maintenance position and is repaired. After repair, it is moved back into its application position. Alternatively or in addition, there may be a back-up applicator for the second applicator 14.2.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A method for producing an engineered wood board, comprising:

(a) production of a substrate;

(b) application of a fluid onto an application area of the substrate by means of an applicator; and (c) monitoring of the application of the fluid onto the application area of the substrate by an infra-red camera such that an inhomogenity of the application of the fluid is recorded, wherein:

the production of the substrate comprises a scattering of wood fibres coated in an adhesive that results in a pressed fibre mat;

the fluid is applied to the fibre mat after the scattering;

the fibre mat is pressed to form an engineered wood board following the application of the fluid; and the infrared camera automatically monitors the application of the fluid in a discharge area behind the application area of the fluid by monitoring a temporal temperature distribution at the application area that is caused by the application of the fluid to determine an inhomogeneity of the temperature in the discharge area.

2. The method according to claim 1, wherein the monitoring of the application occurs with the infra-red camera by recording the inhomogeneity of the application by means of the temperature change effected by the application of the fluid.

3. The method according to claim 1, wherein:

(a) the pressed fibre mat is pressed to form an engineered wood board using a hot press following the application of the fluid.

4. The method according to claim 3, wherein the hot press is a heated belt press.

5. The method according to claim 1, wherein:

the substrate has a substrate temperature in a material flow direction in front of the applicator; and the fluid has a fluid temperature during application that differs from the substrate temperature by at least 1 Kelvin.

6. The method according to claim 5, wherein the temperature is at least 5 Kelvin.

7. The method according to claim 1, further comprising:

continuous automatic recording of an inhomogeneity parameter that describes an inhomogeneity in the application of the fluid; and emission of a signal if the inhomogeneity parameter deviates from a predetermined nominal value by more than a predetermined threshold value, or indication of the inhomogeneity parameter.

8. The method according to claim 7, wherein the inhomogeneity parameter describes an application area temperature difference within the application area.

9. The method according to claim 1, wherein the application involves spraying.

10. The method according to claim 9, wherein the spraying is an atomisation.

11. An engineered wood board production installation that is designed for producing an engineered wood board, comprising:

(a) a substrate production installation for producing a substrate;

(b) an applicator for applying a fluid to an application area of the substrate; and (c) an infra-red camera that is designed for automatic recording in a discharge area behind at least one part of the application area of the fluid such that an inhomogeneity of the application of the fluid can be recorded and the infrared camera monitors the application of the fluid by means of monitoring a change of temperature that is caused by the application of the fluid in the discharge area.

12. The engineered wood board production installation according to claim 11, wherein the applicator is designed to apply the fluid at a temperature that differs from a substrate temperature, which the substrate exhibits prior to the application, by at least 1 Kelvin.

13. The engineered wood board production installation according to claim 12, wherein the temperature is at least 5 Kelvin.

14. The engineered wood board production installation according to claim 11, wherein the infra-red camera is part of an inhomogeneity monitoring device, which is installed for:

continuous automatic recording of an inhomogeneity parameter that describes an inhomogeneity in the application of synthetic resin, and automatic emission of a signal if the inhomogeneity parameter deviates from a nominal value by more than a predetermined threshold value.

15. The engineered wood board production installation according to claim 11, wherein the inhomogeneity of the application of the fluid monitored by the infrared camera is used to determine if the applicator is not working properly or a liquid tank containing the fluid is empty.

16. A method for producing an engineered wood board, comprising:

(a) application of a fluid synthetic resin onto an application area of a substrate;

(b) monitoring, in an area behind the application area, the application of the fluid synthetic resin by an infra-red camera which monitors a change of temperature that is caused by the application of the fluid synthetic resin;

(c) determining an inhomogeneity of the temperature of the fluid synthetic resin in the area behind the application area, based on the monitoring; and (d) pressing the substrate into a fibre mat to form an engineered wood board, prior to the application of the fluid synthetic resin;

wherein the application of the fluid synthetic resin is onto a moulding skin of the engineered wood board.

17. The method according to claim 16, wherein the fluid synthetic resin contains a melamine resin and/or a urea resin.

18. The method according to claim 16, wherein the substrate comprises a scattering of wood fibres coated in an adhesive that results in the pressed fibre mat and a fluid is applied to the fibre mat after the scattering.

19. The method according to claim 16, wherein the determining of the inhomogeneity of the application of the fluid synthetic resin is used to determine if an applicator is not working properly or a liquid tank containing the fluid synthetic resin is empty.

20. A method for producing an engineered wood board, comprising:

(a) production of a substrate;

(b) application of a fluid onto an application area of the substrate by means of an applicator; and (c) monitoring of the application of the fluid onto the application area of the substrate by an infra-red camera such that an inhomogenity of the application of the fluid is recorded, wherein:

the application of the fluid is an application onto a moulding skin of the engineered wood board;

the fluid is a fluid synthetic resin and contains a melamine resin and/or a urea resin; and the infrared camera automatically monitors the application of the fluid in a discharge area behind the application area of the fluid by monitoring a temporal temperature distribution at the application area that is caused by the application of the fluid to determine an inhomogeneity of the temperature in the discharge area.

21. The method according to claim 20, wherein the moulding skin is an unpolished moulding skin.

22. The method according to claim 20 further comprising:

application of at least one paper layer impregnated with a synthetic resin on an upper side and/or a lower side of an engineered wood board, resulting in a paper-coated engineered wood board; and pressing of the paper-coated engineered wood board such that the synthetic resin fuses and the paper layer bonds with the engineered wood board, where the fluid is applied in the form of prior to the application of the paper layer.

23. The method according to claim 22, wherein the least one paper layer, is a decorative paper layer and the fluid is a fluid synthetic resin.

24. The method according to claim 20, wherein the application involves spraying.

* * * * *